US005918425A

United States Patent [19]

Archard et al.

[11] Patent Number: 5,918,425

[45] Date of Patent: Jul. 6, 1999

[54] EAVE BLOCK, VENT AND CHANNEL ARRANGEMENT

[75] Inventors: William L. Archard; Rand A. Hopkinson; Sharon B. Hopkinson, all of Rangeley, Me.

[73] Assignee: W. Archard, Rangeley, Me.

[21] Appl. No.: 08/990,203

[22] Filed: Dec. 13, 1997

[51] Int. Cl.[6] ..... E04B 7/00

[52] U.S. Cl. ..... 52/95; 52/199

[58] Field of Search ..... 52/95, 96, 199, 52/302.3

[56] References Cited

U.S. PATENT DOCUMENTS 3,777,649 12/1973 Luckey ..... 52/95 X

*Primary Examiner*—Creighton Smith

*Attorney, Agent, or Firm*—Don Halgren

[57] ABSTRACT

The present invention comprises an article and a method of preventing undesired wind and moisture encroachment into the space between adjacent joists and rafters of a building. The method includes the steps of: providing an elongated flexible web article having a foraminous elongated first side edge portion and a pair of elongated, wind-impermeable, second sides co-extensive and co-attached with said first side portion; attaching the first foraminous long side to the rafters; cutting a portion of the wind-permeable material and the second wind impermeable sides on the rafters; draping the flaps now defining the cut first and second sides of the elongated web down between the joists; and securing the lower end of one flap to the vertical outside wall, and pulling the remaining second side flap back over the insulation between the rafters, to provide an eave block, vent and channel arrangement between the joists and to permit controlled ventilation between the rafters.

13 Claims, 6 Drawing Sheets

EAVE BLOCK, VENT AND CHANNEL ARRANGEMENT

BACKGROUND OF THE INVENTION

1. Field of the Invention

This invention relates to a baffle arrangement to control heating and cooling loss along with controlling wind and moisture at the perimeter and attic area of buildings.

2. Prior Art

Mold, mildew, ice damage, heat loss, cooling loss and condensation are problems that builders and homeowners have to deal with in their structures. These problems arise no matter whether the structure is in a heating climate or in a cooling climate. Problems of mold and mildew may arise in either. In the heating climates, thermal insulation in ceilings may be of a reduced thickness at the building perimeters, due to width geometry. This results, however, heating and cooling losses at those perimeters, which may result in condensation formation thereat. These warm or cool spots may lead to higher surface relative humidities, mold and mildew buildup. Builders in such areas have used roof framing with high-heel trusses, to allow greater thickness of ceiling insulation to be installed at those perimeters, to reduce heat and cooling loss thereat. However, wind and moisture may still infiltrate the construction and sabotage insulation performance. Eave blocks are used by some in an effort to control wind washing and to reduce mold and mildew growth at those perimeters of the building.

In both types of construction when soffit vents are utilized, there is a need for blocking at the eaves while still allowing for an air channel directly below the roof sheathing for venting into the attic areas.

Mold and mildew are problems in both heating and cooling climates, where warmer and cooler air meet, thus creating moisture concerns. Cold surfaces in cooling climates may occur when air conditioning the interior of the buildings. As the exterior hot air is cooled, its relative humidity increases. If the exterior hot air is also humid, the cooling of the air will increase its relative humidity to the point at which moisture and mold growth may occur, typically 70%. Sometimes, the relative humidity may increase to 100%, resulting in condensation.

For effective ventilation through the soffit area, free flowing air channels must be provided to allow passage of air and moisture out through the attic area. It is important to maintain proper ventilation and uniform temperature in both heating and cooling climates so as to release moisture through air transfer and evaporation.

In order to minimize the moisture buildup and the inherent damage it causes, both to wood structures and to any insulation or surface thereadjacent, the prior art teaches ventilating the area of the overhang of the roof adjacent to a wall. In this area called a soffit, some form of eave block and vent is needed to control and direct air flow, to help prevent insulation damage along with other associated problems. Wind washing through a soffit vent without an eave block vent and channel will sabotage the insulation in a room between the rafters thereof and the adjacent joists of the ceiling thereunder, thereby minimizing insulation effectiveness.

A number of attempts at ventilating the roof and soffit area are shown in the art. For example, U.S. Pat. No. 5,473,847 to Crookston shows a ventilated insulating roofing system, which however, utilizes a very complicated arrangement of rigid insulation through their channels. This unfortunately is very costly and complicated to assemble. U.S. Pat. No. 5,361,551 to Post shows a ventilation spacer for roof construction wherein a rigid strip of corrugated metal or plastic having slits permits inflow of air under the roof shingles and sheeting therewith. This again is relatively expensive and somewhat complicated to install. U.S. Pat. No. 5,339,577 to Snyder shows a laminated noncombustible board for forming ductwork and headers. This construction requires a corrugated building material to be arranged between the rafters and the roof sheathing. It is expensive and yet another difficult attempt at solving the moisture buildup problem.

Moisture removal is shown in U.S. Pat. No. 4,840,515 to Freese wherein a subterranean drain includes a multilayed panel with frusto-conical members therebetween for fluid drainage from a wall surface. Needless to say, this is an expensive and cumbersome approach to the solution of the problem. U.S. Pat. No. 4,807,409 to Sells shows a vented fascia board for positioning between the roof and the soffit of a building. This soffit board requires ventilation channels therethrough. It would be expensive to manufacture and is of a rigid nature, so as to make its construction and use somewhat complicated.

It is an object of the present invention, to provide an eave block, vent and channel arrangement which may be easily and readily placed in a roof assembly, in any one of several construction arrangements. This arrangement is to prevent air infiltration and moisture from damaging insulation arranged between the joists and/or rafters of a building, yet permit required ventilation and allow air to flow properly over the insulation and under the roof sheathing between the rafters. The air should ultimately exit through attic venting areas.

It is yet a further object of the present invention, to prevent a double vapor barrier, and to provide an eave block, vent and channel arrangement that is easy to manufacture, simple to install, and is readily adjustable at the site of construction, to permit varying degrees of ventilation in the building where it is utilized.

It is still yet a further object of the present invention to impede air flow thereby channeling and evenly distributing air into the attic area of a building from the soffit area of that building.

BRIEF SUMMARY OF THE INVENTION

The present invention comprises an eave block, air vent, channel and moisture control arrangement, consisting of a compound elongated flexible web of material having a first side portion thereof of elongated foraminous material of screen-like construction. This elongated web of air-permeable material extends the entire elongated length of the eave block, vent and channel arrangement. It preferably has a width of from at least about two to about four inches.

The second component of the eave block, vent and channel arrangement comprises an elongated web of wind-impermeable material extending the length of the eave block, vent and channel arrangement. The wind-impermeable material is fixedly attached to an elongated or second edge of the elongated screen-like material. The second elongated web of wind-impermeable material has a width range of at least about six to at least about twenty four inches.

In one embodiment of the elongated web of foraminous or screen-like material, a strip of flexible reinforcing material such as tape or the like is arranged thereon, to facilitate attachment of the web of screen material to a roof construction and to help prevent possible damage to the foraminous portion while installing the roof sheathing.

In a further preferred embodiment of the present invention, the wind-impermeable layer may have an additional layer attached along one edge, to the second edge of the screen-like material.

In utilization of the present invention, it is preferred that the wind-impermeable portion of the flexible web be folded over onto itself, so as to permit ease of use and facilitate cutting during installation. Building structures are typically comprised of vertical walls. The walls of the building have a plurality of parallel spaced-apart joists thereabove. A plurality of rafters defines the sloped surface of a roof. The rafters are spaced apart and are attached adjacent to each respective joist. Insulation is placed between the joists or rafters to provide a proper and constant temperature within the room defined by the walls and the ceiling under the joists. The insulation between the joists may extend to the outside surface of the vertical wall and beyond, being defined as the soffit area. Typically, this soffit area is enclosed and may have a plurality of vent openings to permit air to enter in an effort to help create an even and uniform temperature area, thus helping to prevent condensation and moisture problems.

In the present invention, the installation of the elongated web material may be unrolled across the rafters, at a location generally vertically above the outside of the external wall prior to placing sheathing on the roof. The reinforced portion of the foraminous or screen-like material area may be attached by staples, adhesive, or by other means, to the upper edge of each respective rafter as it is rolled thereacross. The folded-over web of wind-impermeable material is to be cut up to or beyond its juncture with the foraminous portion on the top edge of the rafters. After these cuts have been made on adjoining rafters, a narrow block of air/wind permeable material and a larger, generally rectangular web of wind-impermeable material may be draped or folded down, fitting between those rafters, its lower end being affixed to the outside of the wall sheathing. This flap of wind-impermeable material thus creates a wind barrier in front of the insulation between the joists, while the foraminous material allows a controlled amount of air to flow directly under the roof sheathing between adjacent rafters and into the attic venting areas. The foraminous or web of screen-like material thus hangs slightly down beneath the roof sheathing, so as to permit an area of controlled ventilation above the insulation. The length of the cut made across the foraminous material will define the width of the foraminous material hanging down from the plane as defined by the uppermost surface of the rafters.

In a further preferred embodiment, the elongated web of foraminous or screen-like material has at least two layers of wind-impermeable material attached to its lowermost edge. The second or rearmost flap may be pulled over the insulation layer between the joists, thus providing a further air and moisture channel to that immediate area. Roof sheathing would be then placed over the rafters and over the web of foraminous material which was stapled, glued with adhesive, or attached by other means, to the uppermost surface of those rafters which are adjacent the vertical wall.

A further embodiment of the present invention may occur during the application of the roof sheathing. The sheets of typically plywood roof sheathing may have the web of foraminous or screen-like material pre-attached as by stapling or being adhered thereto, a spaced-apart distance from its lowermost edge, in proper alignment with the vertical supporting wall beneath the rafters. The pre-attachment of the upper edge of the foraminous material to the bottom side of the roof sheathing permits that roof sheathing and eave block, vent and channel arrangement to be placed over the rafters. Then the eave block, vent and channel arrangement may be cut against the bottom-side of the roof sheathing adjacent and parallel to the supportive rafters. Those sections of the wind permeable and the wind-impermeable material dropping/hanging down between the rafters and joists, the lower end of which wind-impermeable portion may be stapled or adhered to the outside of the wall sheathing and the rearmost flap of wind-impermeable material pulled over the top of the insulation between the joists or rafters.

A retrofit application of the eave block, vent and channel arrangement includes the applying of such web arrangement in short sections between adjacent joists and/or rafters after the roof sheathing has been applied. The individual sections of eave block, vent and channel arrangement are fit between the rafters, and the upper edge of the wind/air permeable portion being appropriately attached to the lower side of the roof sheathing and between the rafters, the lower side of the wind permeable portion and the front section of wind impermeable material hanging down between those rafters and is attached to the inside or the outside of the outside wall. The other flap of the pair of wind impermeable material flaps may be pulled over the top of the insulation between the joists or rafters as a cover therefor.

The invention thus comprises a method of preventing undesired air infiltration and moisture encroachment into the space between adjacent joists and rafters carried on a vertical supporting wall, comprising the steps of: providing a flexible web having an elongated foraminous first side portion and a co-extensively joined, elongated wind impermeable second side portion; attaching an upper edge of the foraminous first side portion to an upper edge of the rafters; cutting the elongated second side-portion and part of the foraminous first side-portion transversely thereto, on the rafters so as to form flaps of part of the first and all of the second side portions; draping the flaps down between the joists; and securing the lower end of the flaps to the vertical support wall to provide an air and moisture barrier between the joists and to permit ventilation between the rafters through the foraminous portion securely supported between adjacent rafters. The method includes the step of securing the second side portion to the rafters; attaching a roof sheathing to the rafters above the elongated flexible web; stapling the first long side to the rafters at an upper edge thereof.

The invention also includes a method of manufacturing an eave block, vent and channel arrangement to prevent air and moisture infiltration, the sabotage of insulation arranged between adjacent joists and rafters, as well as to promote stable interior/exterior air pressure balance, comprising the steps of: arranging a web of flexible foraminous screen-like wind-permeable material in an elongated strip co-extensively joined with an elongated web of flexible wind-impermeable material, so as to permit both of the webs to be applied to a roof structure, and to permit at least a portion of the foraminous material along with the wind-impermeable material to drape between the rafters during an installation process; arranging sheathing material as a roof; attaching an upper edge of the foraminous or wind permeable material to a lower side of the roof sheathing material; and securing the roof sheathing material to the upper side of the rafters; cutting partway through the wind permeable and completely through the wind impermeable portion against the lower side of the roof sheathing adjacent the rafters, to form a flap of foraminous wind permeable material and wind impermeable material to fall between adjacent rafters and joists; and pulling the lower end of a second cut flap over a layer of insulation arranged between the joists, so as to permit the second of wind impermeable material to protect the insulation thereunder, while creating an air channel through the foraminous portion and over the top side of the wind impermeable portion between the rafters.

The invention also includes an eave block, vent and channel arrangement for application to a roof structure of a building to prevent undesired air and moisture infiltration between adjacent rafters and joists, and to prevent sabotage of insulation therein, comprising: an elongated, flexible web of foraminous material; and at least one elongated, flexible web of wind impermeable material attached to the elongated flexible web of foraminous material along one side edge thereof; the elongated web of foraminous material and wind impermeable material arranged to be cut to permit the web between adjacent cuts to hang between adjacent joists of the building to which the eave block, vent and channel arrangement is applied. A reinforcement strip may be disposed upon an edge of the elongated, flexible foraminous material, to strengthen and facilitate attachment of the foraminous material to the roof structure. At least two wind impermeable webs of flexible material may be arranged, overlapping with respect to one another and contiguous to the web of flexible foraminous material. The web of flexible, foraminous material is preferably at least about 4 inches wide, in order to provide material thereof to be attached to the roof structure, and to permit some material thereof to hang down between adjacent rafters of the roof structure, and provide an air flow path between the web of flexible wind impermeable material and the roof structure. At least one of the webs of wind impermeable material is long enough to permit a distal end thereof to be attached to an adjacent wall or component of the building, while providing an eave block to portions of the building. The two webs of flexible, wind impermeable material may have similar widths, to permit the rearwardly arranged one of the two webs to be pulled over insulation between adjacent joists as a blanket, for protection thereof. At least one of the two webs of flexible, wind impermeable material has a range of preferred width of at least about six to about twenty four inches, to provide a channel to air passing through the web of foraminous material between the rafters, while protecting the insulation thereunder.

BRIEF DESCRIPTION OF THE DRAWINGS

The objects and advantages of the present invention will become more apparent, when viewed in conjunction with the following drawings, in which.

DESCRIPTION OF THE PREFERRED EMBODIMENTS

Figure 1:
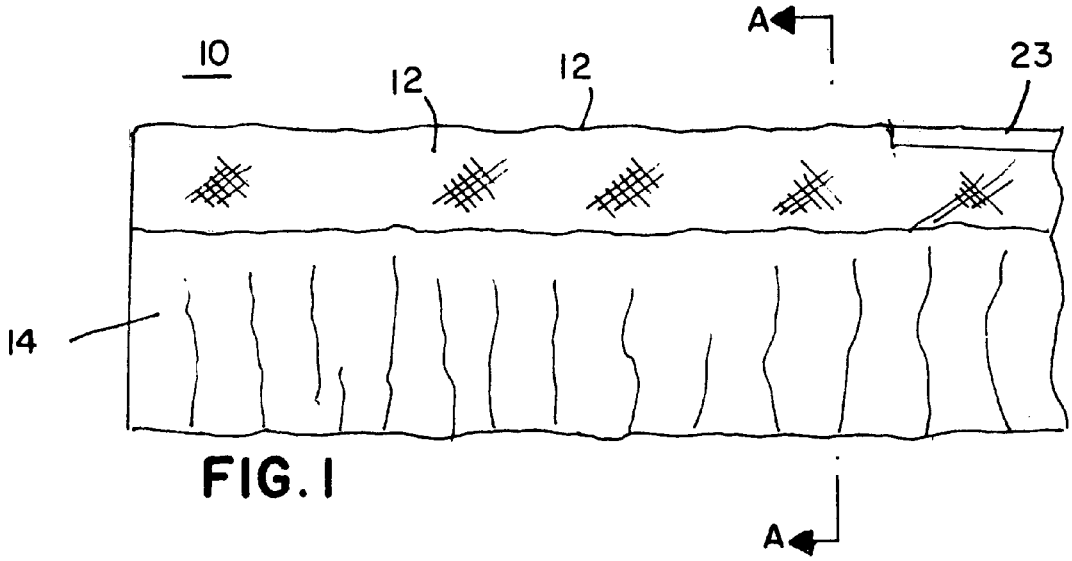
FIG. 1 is a plan view of the elongated web of eave block, vent and channel arrangement constructed according to the principles of the present invention.

Referring now to the drawings in detail, and particularly to FIG. 1, there is shown the present invention which comprises an eave block, vent and channel arrangement 10, comprising several elongated flexible webs of material having a first side portion 12 thereof of elongated foraminous material or screen-like construction, (with small openings sufficient to permit airflow and air transfer therethrough), and a second side portion 14. The elongated web or side portion 12 of air-permeable material extends the entire elongated length of the eave block, vent and channel arrangement 10. Preferably, it has a width of at least about two to about four inches.

Figure 3:
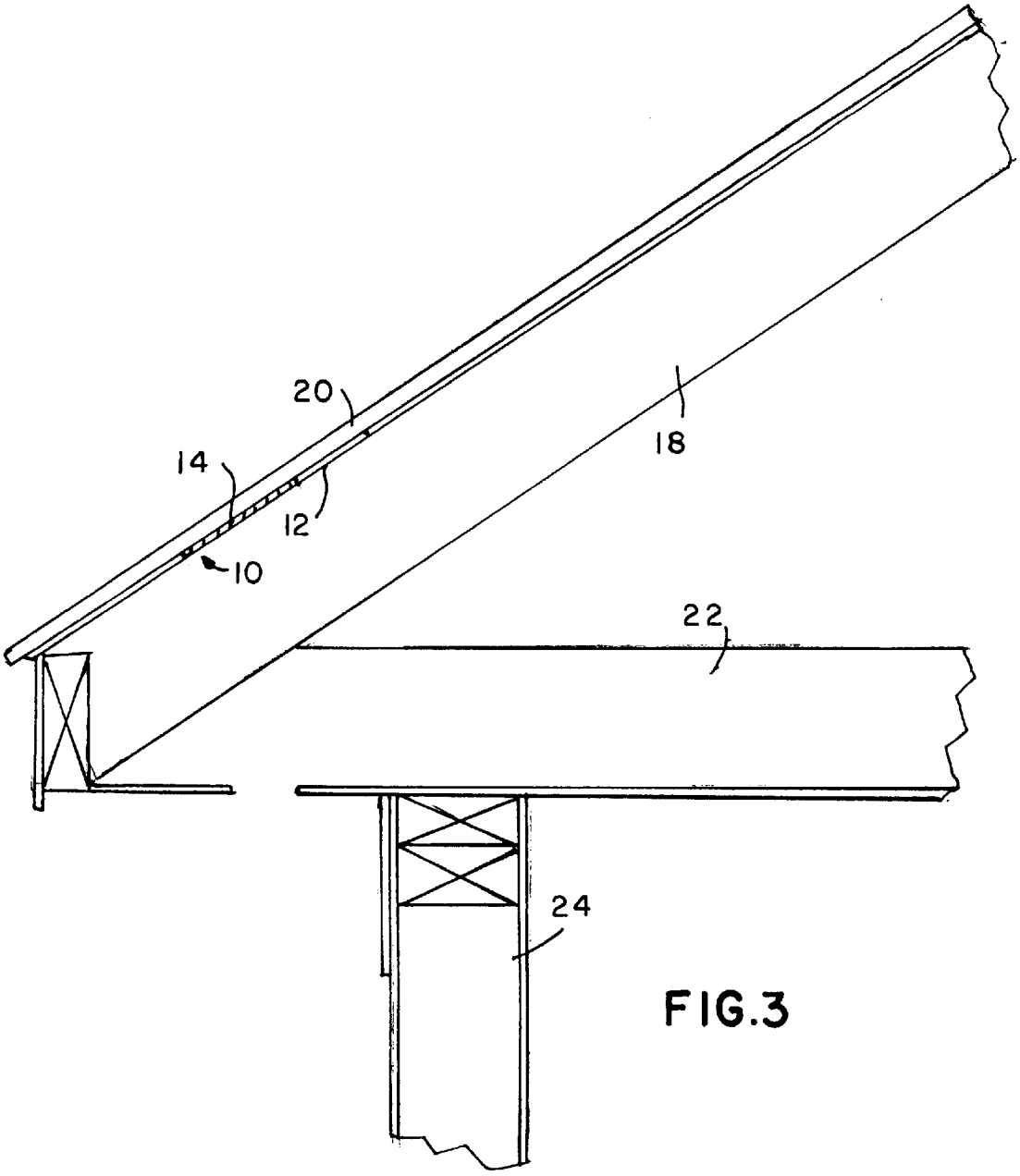
FIG. 3 is a side-elevational view of a building construction, showing a wall, joist, rafter and roof sheathing arrangement with an eave block, vent and channel arrangement of the present invention shown attached to an upper edge of the rafters.
Figure 4:
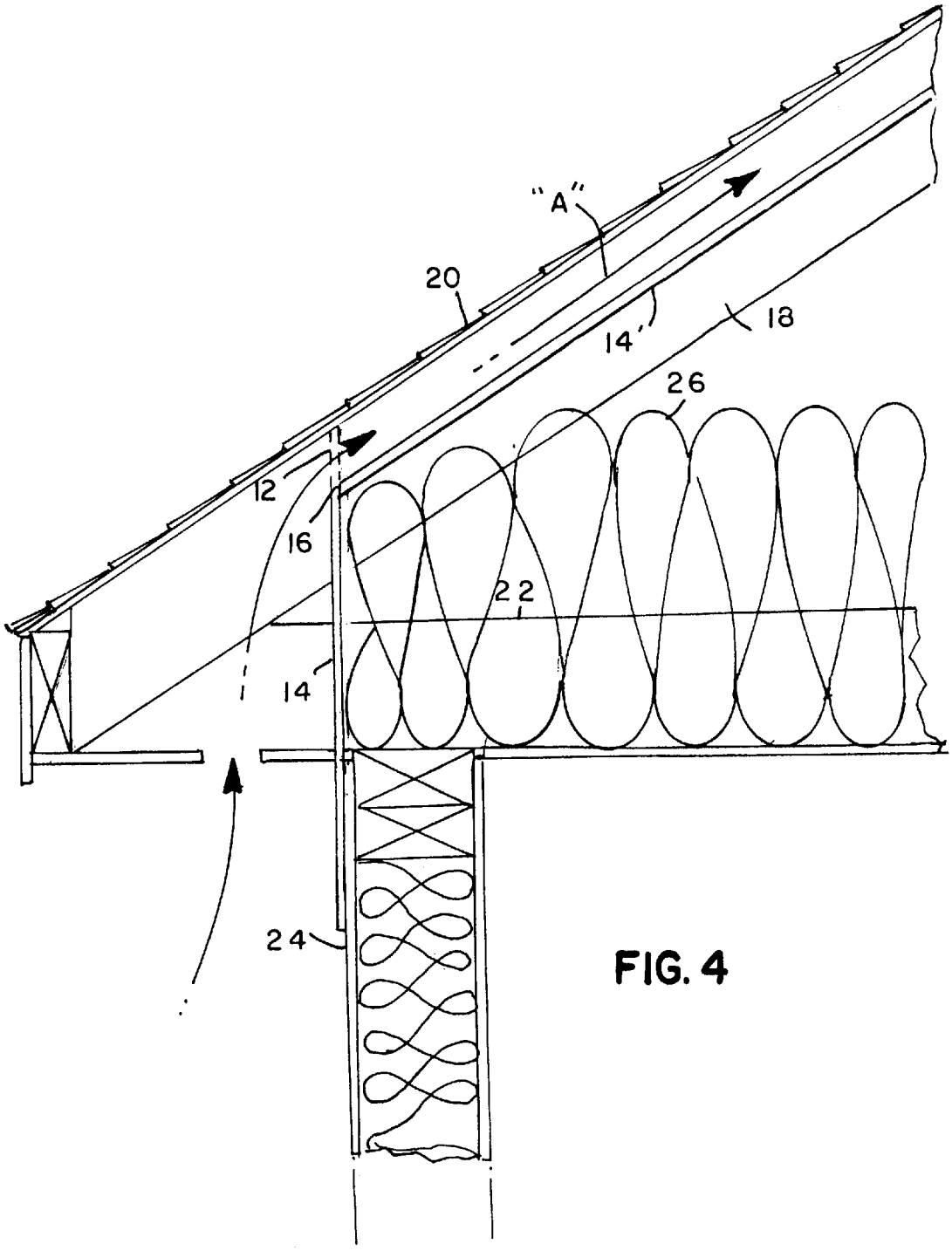
FIG. 4 is a view similar to that of FIG. 3, showing a wall, joist and rafter construction with an eave block, vent and channel arrangement attached to the lower side of a roof sheathing placed on top of the rafters.

The second webbed portion 14 of the eave block, vent and channel arrangement 10 comprises a second elongated web of flexible, wind-impermeable material extending the length of the eave block, vent and channel arrangement 10, as may be seen in FIG. 1. The second web of wind-impermeable material 14 is fixedly attached to and contiguous with a second edge 16 of the elongated screen-like material 12, as may be seen in cross-section in FIG. 2. The second elongated web of wind-impermeable material 14 has a width of at least about one foot, or long enough to adhere adjacent to the upper edge of a rafter 18 of a building, as shown in FIG. 3, or to the lower side of the roof sheathing 20, as shown in FIG. 4, with the lower or distal end (the impermeable portion) hanging down between the rafters 18 and the joists 22 thereadjacent and attached to the wall.

Figure 2:
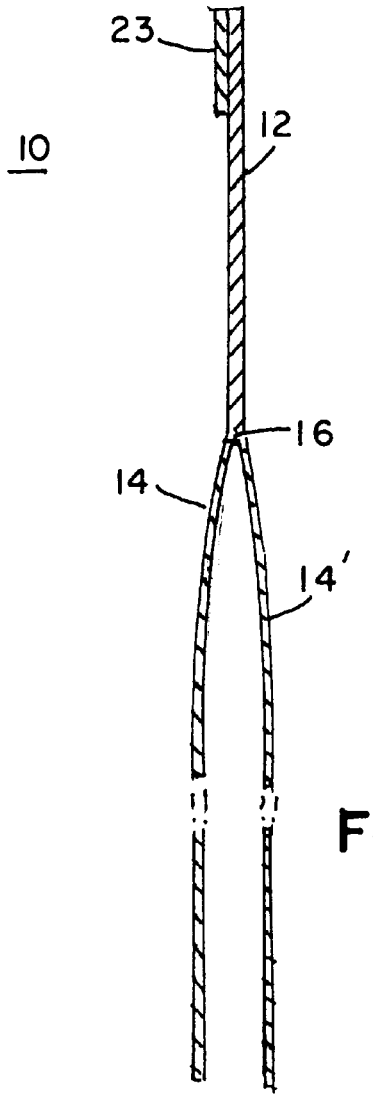
FIG. 2 is a cross-sectional view taken along the lines A—A of FIG. 1.

In one preferred embodiment for the elongated web of foraminous or screen-like material 12, as shown in FIGS. 1 and 2, there is disposed thereon a strip of flexible reinforcement material 23, such as tape or the like, to provide strength and tear resistance thereto, and to facilitate attachment of the web of wind permeable screen material 12 to a roof construction.

In a further preferred embodiment of the present invention, the wind-impermeable layer 14 may have a second corresponding layer 14', as shown in FIG. 2, each attached along a common edge, to the second edge 16 of the first web of screen material 12.

In utilization of the present invention, it is preferred that the wind-impermeable portion of the flexible web be folded over onto itself, and rolled-up so as to permit ease of application to the roof structure and to facilitate cutting during installation. The typical building structure may include a vertical supporting wall 24, as shown in FIGS. 3 and 4, and as typically found in a home or building. The walls of the building have a plurality of parallel spaced-apart joists 22 thereabove. The upper side edge of a plurality of rafters 18, defines the sloped surface of a roof. The rafters 18 are spaced apart and are attached adjacent each respective joist 22 at their juncture with the vertical wall 24. Insulation 26, as shown in a side representation in FIG. 4, is placed between the joists 22 or rafters 20 to help maintain a proper and constant temperature within the room defined by the walls and the ceiling under the joists. The insulation 26 may extend to and beyond the outside surface of the vertical wall 24. The area between the outside surface of the vertical wall and the overhang of the rafters 18, is defined as the soffit area. Typically, this soffit area is enclosed and may have a plurality of vent openings to permit air to enter in an effort to prevent moisture buildup in the areas involving the roof sheathing, the rafters and the attic beneath the rafters and above the joists.

Figure 5:
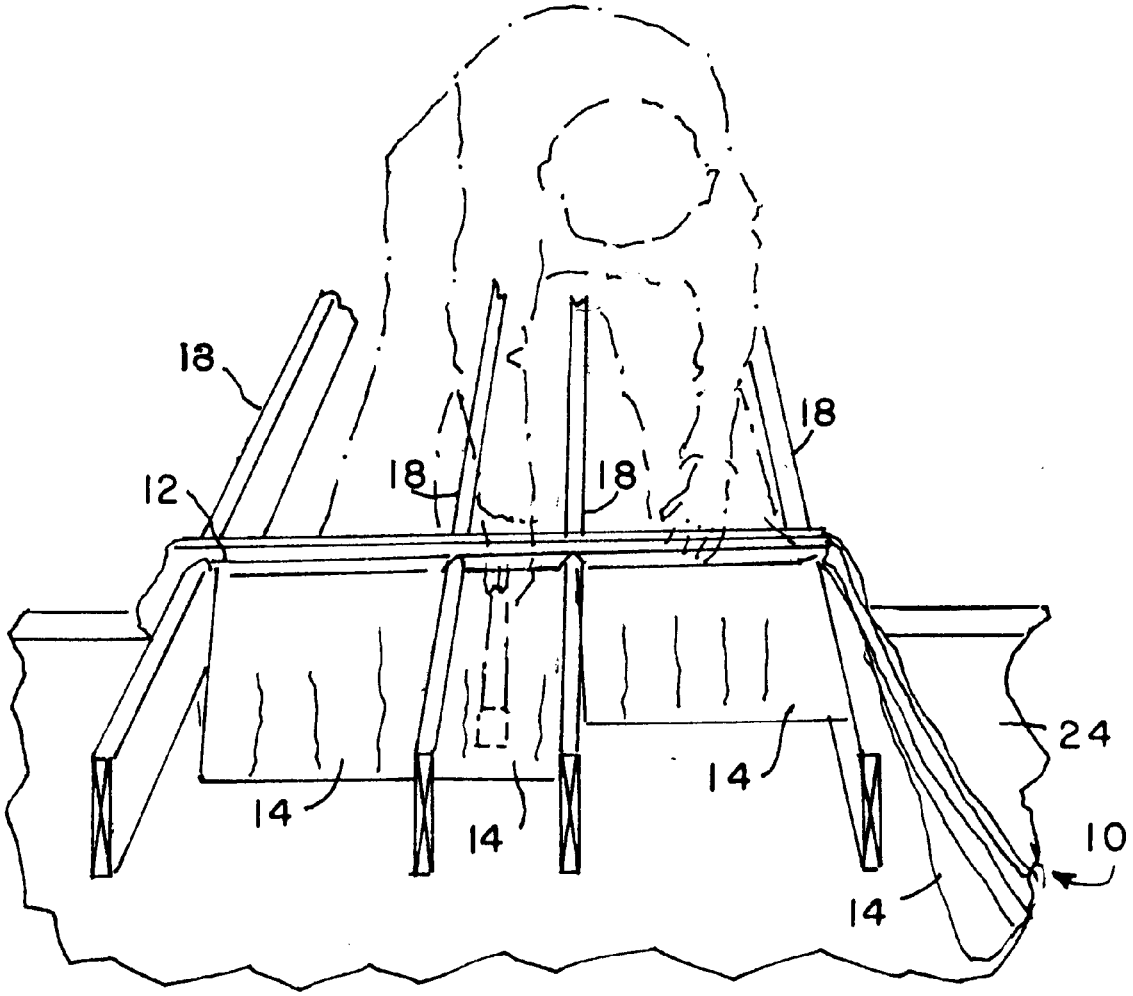
FIG. 5 is a view similar to that shown in FIG. 4, with the eave block, vent and channel arrangement having been cut and having its lower flap end attached to the upper edge of the wall.
Figure 6:
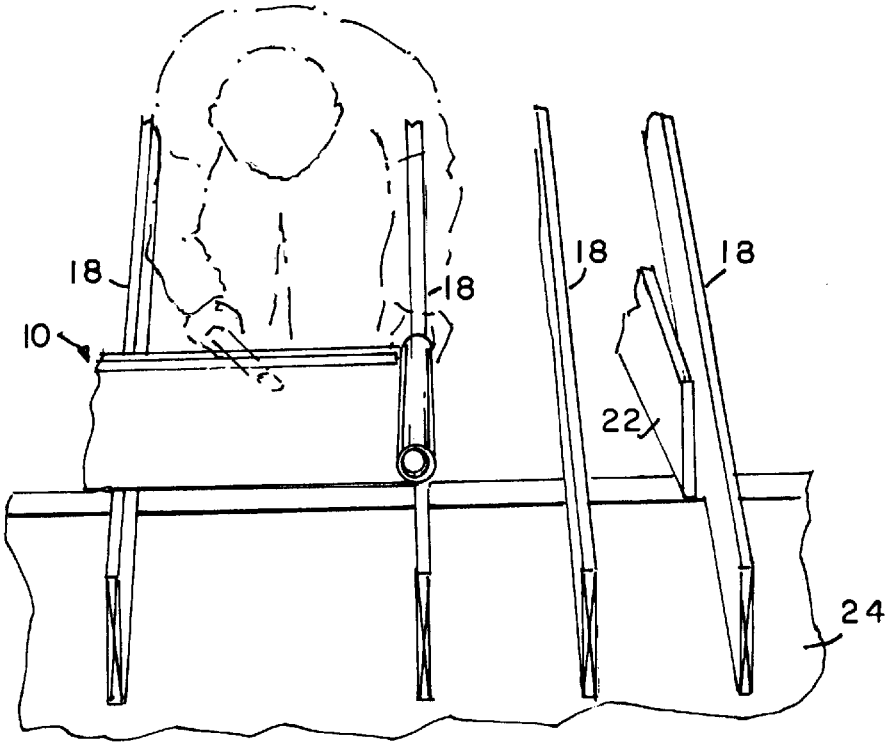
FIG. 6 is a representation of the assembly process of the eave block, vent and channel arrangement being attached to the upper surface of a pair of rafters.
Figure 7:
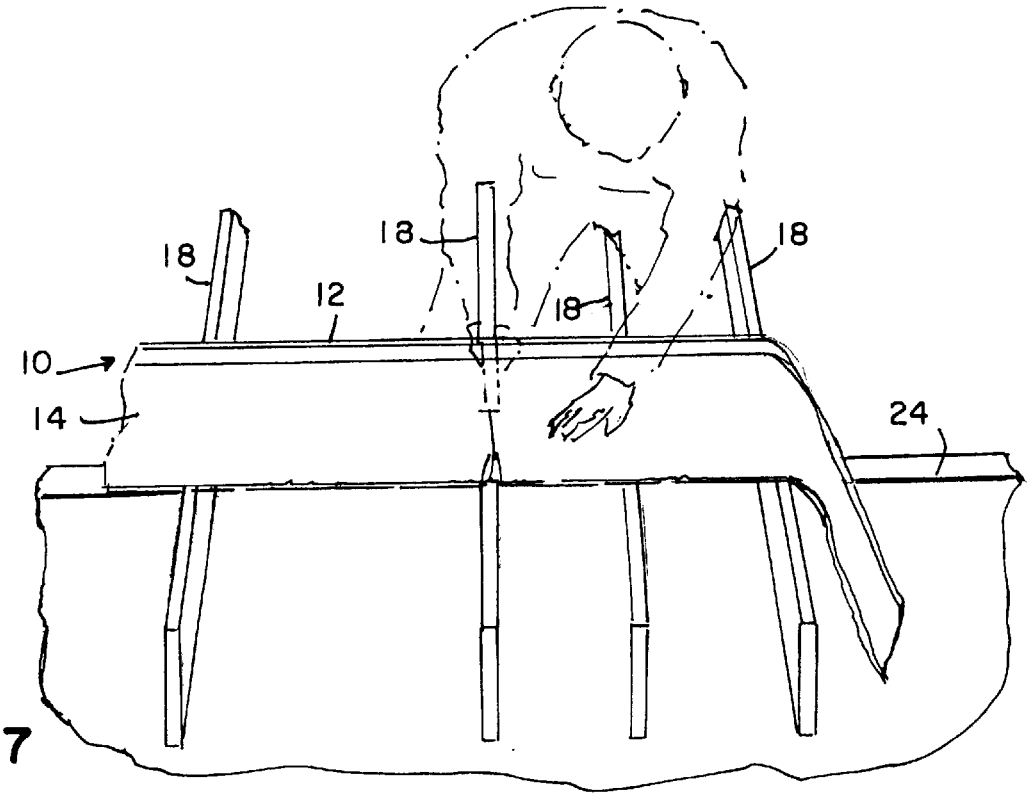
FIG. 7 is a view similar to that of FIG. 6, showing the wind-impermeable web being cut.
Figure 8:
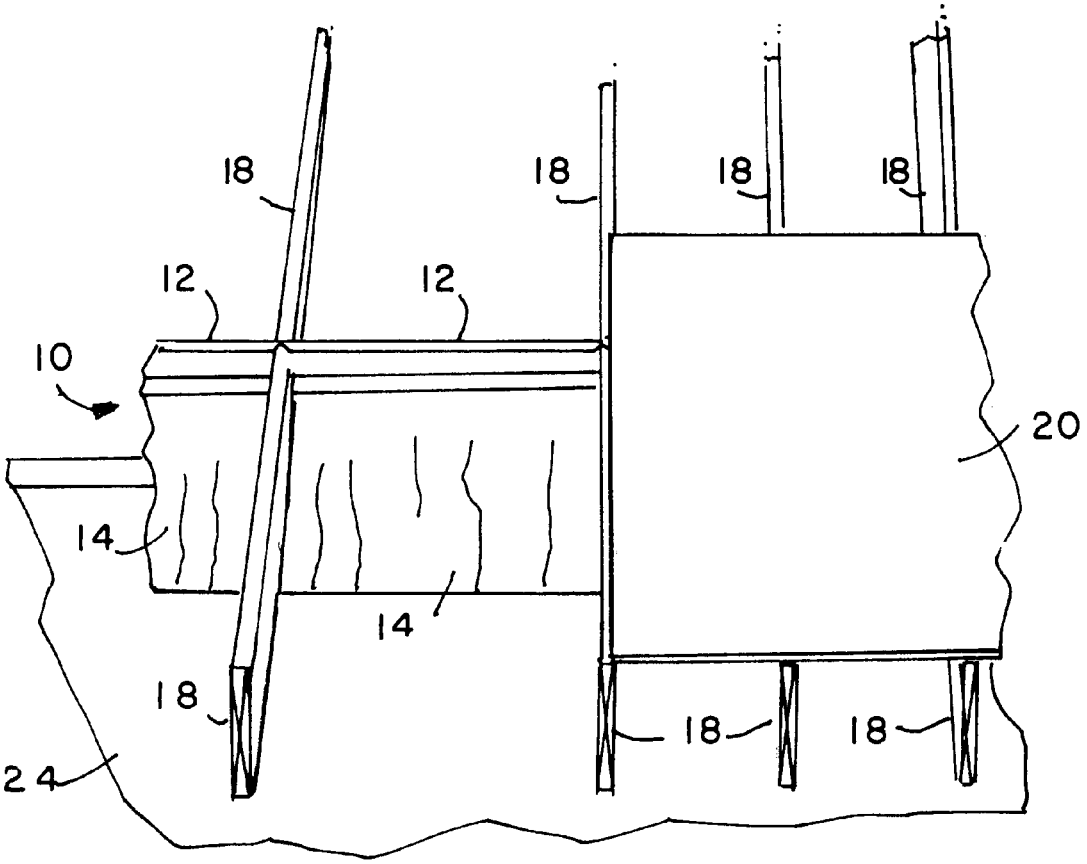
FIG. 8 is a side-elevational view of a plurality of rafters with the eave block, vent and channel arrangement attached therebetween and at least a portion of roof sheathing placed thereover to show the relationship thereof.

In the present invention, however, a rolled-up elongated web of eave block, vent and channel arrangement 12 is unrolled by an operator, across the rafters 18, as shown in FIG. 6, above the external wall 24. An upper edge of the foraminous or reinforced wind permeable screen portion 12 may then be attached by staples or adhesive, to the upper edge of each respective rafter 18, as it is unrolled thereacross. The folded over web of wind-impermeable material 14 may be cut (i.e. with a knife or razor) on the top edge of the rafters 18, and also cut up to and through part of the foraminous material 12, as may be seen in FIG. 7. After this cut has been made on adjacent rafters, a narrow width of foraminous material 12 and a generally rectangular piece or flap of wind-impermeable material 14 may be folded down fitting between those rafters and affixed to the outside of the wall sheathing 24, as shown in FIG. 5. This narrow section of foraminous material 12 permits some air to flow between the rafters 18 and under the roof sheathing 20, and the remaining flap of wind-impermeable material 14 hanging down between the joists 22, creates a wind barrier to wind washing of the insulation 26 spaced therebehind, between those adjacent joists 22, to which those rafters 18 are attached. The foraminous web of screen-like material 12 may hang slightly down from the top of the rafters 18, as shown in FIG. 4, so as to permit an area "A" of controlled ventilation above the insulation 26. The length of the cut made across the wind-impermeable material 14, and into the screen material 12 will define the amount of vent screen hanging down from the plane defined by the uppermost surface of the rafters.

In a further preferred embodiment, the elongated web of foraminous or screen-like material 12 has at least two layers of wind-impermeable material 14 and 14' attached to its lowermost edge, as shown in FIG. 2. The second or rearmost flap 14' of the two layers 14 and 14' may be pulled over the insulation layer 26 between the joists 22, as shown in FIG. 5, thus providing a further air and moisture barrier to that immediate area.

Roof sheathing would be then placed over the rafters 18 and over the web of foraminous material 12, the upper edge of which being stapled, glued with adhesive, or affixed by other means to the uppermost surface of those rafters 18, a narrow band of the air pervious portion along with the wind impermeable portions 14 hanging down to and attached to the vertical wall 24.

In a further embodiment of the present invention, the roof sheathing 20, typically sheets of plywood, may have the web of foraminous or screen-like material pre-stapled or adhered thereto, on its bottom side, a spaced-apart distance from its lowermost edge, as may be visualized from FIG. 3, prior to that sheathing attached to the rafters. This pre-placement of the web material 10 is in proper alignment with the vertical supporting wall 24 beneath the rafters 18, so as to permit the roof sheathing 20 to be placed over the rafters 18, the eave block, vent and channel web arrangement 10 sandwiched therebetween. A cut of the web or eave block, vent and channel arrangement 10 is then made (by a razor or the like), parallel to, and against the bottom side of the roof sheathing adjacent to the supportive rafters, and those flap sections of the air passing (foraminous) material 12 and the wind-impermeable material 14 portions between adjacent razor-made parallel cuts then being permitted to drop down between adjacent rafters 18 and joists 22, so as to allow them to be stapled or adhered to on the sides of their respective rafters, or the distal end of the particular web flaps 14 secured against the top edge of the outer side of the vertical wall sheathing 24, thus creating a small air vent above the wind impermeable portions/flaps and an eave block therebelow and therebehind those flaps.

Thus what has been shown and described is a unique arrangement to guide air beneath the roof sheathing by controlling air and moisture flow and preventing damage of insulation in the area between the soffit and interior of the buildings.

We claim:

1. A method of preventing undesired air and moisture infiltration, and the sabotage of insulation arranged between adjacent joists and rafters supported by a vertical support wall in a building, as well as to promote stable interior/exterior air pressure balance of rooms in that building, comprising the steps of:

providing a flexible web having an elongated foraminous first side portion and a co-extensive, joined, elongated wind impermeable second side portion;

attaching said first side portion to an upper edge of said rafters;

cutting said elongated first and second side portions transversely on said rafters so as to form flaps of said first and second side portions;

draping said flaps down between said joists; and securing the lower end of said flap of said second side portion to said vertical support wall to provide an eave block, vent and channel arrangement between said joists and rafters, while allowing necessary ventilation between said rafters by said foraminous first portion securely supported between adjacent rafters.

2. The method of claim 1, including the step of:

securing said second side to said rafters.

3. The method of claim 1, including the step of:

attaching a roof sheathing to said rafters above said elongated flexible web.

4. The method of claim 1, including the step of:

securing said first long side portion to said rafters at an upper edge of said rafters.

5. A method of manufacturing an eave block, vent and channel arrangement to prevent excess air and moisture infiltration into a space between adjacent rafters and to prevent moisture and air from damaging insulation arranged between adjacent joists or rafters, all of which are supported on a vertical wall in a building, comprising the steps of:

arranging a web of flexible screen-like foraminous, wind-permeable material in an elongated strip co-extensively joined with an elongated web of flexible wind-impermeable material, so as to permit both of said webs to be applied to a roof structure and to permit a part of said wind permeable and said wind-impermeable portions to drape between said rafters during an installation process;

providing an arrangement of roof sheathing material;

attaching an upper edge of said wind permeable material to a lower side of said roof sheathing material;

securing said roof sheathing material to the upper side of said rafters; and cutting at least a portion of said wind permeable portion and said wind impermeable portion against the lower side of said roof sheathing adjacent to said rafters, to form a wind permeable material and wind impermeable material to fall between adjacent rafters and joists.

6. The method of manufacturing flap of an eave block, vent and channel arrangement as recited in claim 5, including the step of:

pulling a lower end of a second cut flap over a layer of insulation arranged between said joists, so as to permit said second cut flap of wind impermeable material to protect said insulation thereunder.

7. An eave block, vent and channel arrangement for application to a roof structure of a building to prevent undesired air and moisture infiltration between adjacent rafters and joists, and to prevent sabotage of insulation therein, comprising:

an elongated, flexible web of foraminous material; and at least one elongated, flexible web of air-impermeable material attached to said elongated flexible web of foraminous material, along one side edge thereof; a part of said elongated web of foraminous material and all of the width of said air-impervious material arranged to be cut, to permit said web between adjacent cuts to hang between adjacent the rafters and joists of the building to which said arrangement is applied, to provide a controlled vent and an eave block thereby.

8. The eave block, vent and channel arrangement as recited in claim 7, including:

a reinforcement disposed upon an edge of said elongated, flexible foraminous material, to strengthen and facilitate attachment of said foraminous material to said roof structure.

9. The eave block, vent and channel arrangement as recited in claim 8, wherein at least two wind impermeable webs of flexible material are overlapping with respect to one another and contiguous to said web of flexible foraminous material.

10. The eave block, vent and channel arrangement as recited in claim 8, wherein said web of flexible, foraminous material is at least about 4 inches wide, in order to provide material thereof to be attached to said roof structure, and to permit part of said foraminous material thereof to hang down between adjacent rafters of said roof structure, thus to provide an air flow path between said web of flexible wind impermeable material and said roof structure.

11. The eave block, vent and channel arrangement as recited in claim 8, wherein said at least one of said webs of wind impermeable material is at least about 12 inches wide, to permit a distal end thereof to be attached to an adjacent wall or component of said building, while providing an eave block to portions of said building.

12. The eave block, vent and channel arrangement as recited in claim 9, wherein said two webs of flexible, wind impermeable material have similar widths, to permit one of said two webs to be pulled a distance over any insulation between adjacent joists as a blanket, for protection of the insulation thereunder.

13. The eave block, vent and channel arrangement as recited in claim 12, wherein at least one of said two webs of flexible, wind impermeable material has a width of at least about 18 inches, to provide a channel by which air passes through said web of foraminous material, and away from any insulation therebeneath.

* * * * *